252-146 AU 166 EX
6/27/78 XR 4,096,871

United States Patent [19]
Vlahakis

[11] 4,096,871
[45] Jun. 27, 1978

[54] DRAIN OPENING METHOD

[76] Inventor: Eftichios Van Vlahakis, Northbrook, Ill.

[21] Appl. No.: 676,570

[22] Filed: Apr. 13, 1976

Related U.S. Application Data

[63] Continuation-in-part of Ser. No. 614,306 Sep. 17, 1975, abandoned.

[51] Int. Cl.[2] ..... B08B 7/04; C23G 1/02
[52] U.S. Cl. ..... 134/40; 134/3; 134/41; 252/140; 252/146
[58] Field of Search ..... ... 252/140, 146; 134/3, 134/41, 40

[56] References Cited

U.S. PATENT DOCUMENTS 1,809,970 6/1931 Holland et al. ..... 252/140
3,538,008 11/1970 Ancel et al. ..... 252/146

*Primary Examiner*—Mayer Weinblatt
*Attorney, Agent, or Firm*—Jacques M. Dulin

[57] ABSTRACT

Discovery of a critical solution temperature vs acid strength profile leads to an aqueous acid-type drain opener composition consisting essentially of a solution of between about 80.8% and 84.5% by weight sulfuric acid. The composition may also contain about 0.1–0.5% by weight corrosion inhibitors, and about 15.0–19.1% by weight of inert materials, including 10–19% water. The resulting drain opener composition is not only effective to dissolve typical drain-clogging materials, but very much safer to use than the conventional highly concentrated (about 93% by weight) sulfuric acid drain openers in terms of providing time-based safety factor against severe acid burns.

1 Claim, 1 Drawing Figure

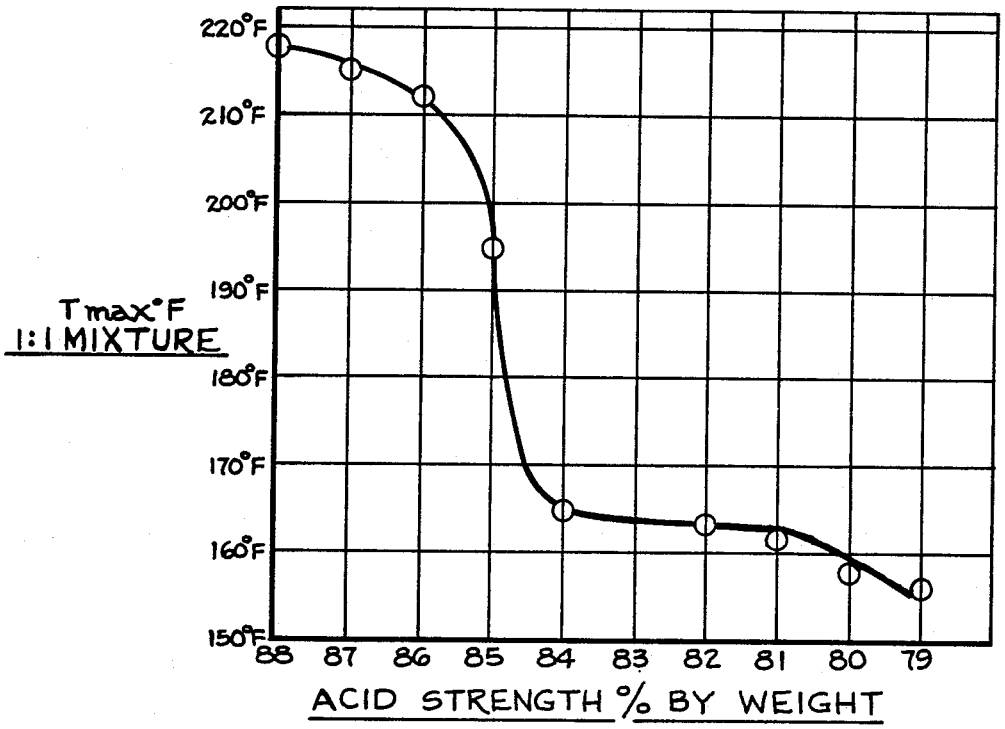
220°F
210°F
200°F
190°F
180°F
170°F
160°F
150°F
Tmax°F
1:1 MIXTURE
88
87
86
85
84
83
82
81
80
79
ACID STRENGTH % BY WEIGHT

DRAIN OPENING METHOD

RELATED CASE

This application is a continuation-in-part of my copending application of the same title, Ser. No. 614,306 filed Sept. 17, 1975, now abandoned in favor of this application.

FIELD

The application relates to sulfuric acid-type drain opener compositions. More specifically, the invention relates to the discovery of critical temperature vs acid strength relationships and to providing safety time periods against severe burns. The result is improved compositions containing an aqueous solution of concentrated sulfuric acid which is "tempered," strong enough to dissolve typical drain clogging materials without extreme danger to severe, instantaneous acid burns.

BACKGROUND

Domestic and industrial drains of all types, particularly in kitchens, bathrooms and utility sinks or tubs, often become clogged by a combination of fatty substances and protein fibers which are usually present in the form of food particles, paper, organic waste, sanitary napkins, cigarettes, hair particles, grease or other organic obstructions. The combination of fat and protein fiber provides a water-insoluble mass which is difficult to dislodge or dissolve. Most liquid drain openers in common use are composed primarily of a concentrated solution of a strong base or acid. One such acid is sulfuric acid, which is well known in the trade and has been used for years as a drain opener at a concentration level of about 93% by weight sulfuric acid. The prior art approach has been to use such high concentrations because of apparent lack of effectiveness at lower concentrations.

Unfortunately, at such high concentration (93% by weight) sulfuric acid is very dangerous. Mere contact with the body results in rapid destruction of tissue, instantly causing severe acid burns. It acts as a powerful destructive agent on the skin, destroying the epidermis and penetrating some distance into the skin and subcutaneous tissues in which it causes necrosis. This causes great pain and if much of the skin is involved, it is complicated by shock, collapse and symptoms similar to those seen in severe burns. The fumes or mists of this material cause coughing and irritation of the mucous membranes of the eyes and upper respiratory tract. Severe exposure may cause a chemical pneumonitis; erosion of the teeth due to exposure to strong acid fumes has been recognized in the industry.

Dry-type drain opener compositions, such as in U.S. Pat. No. 3,538,008, have been proposed. But these have very low acid strength, around 50% in use, which prove ineffective. They also have the serious disadvantage of dusting. Inhalation of the dust may lead to lung damage.

Accordingly, there is a distinct need for an effective, but safe, liquid-type drain opener composition.

THE INVENTION

Objects

It is among the objects of the present invention to provide an effective liquid drain opener composition.

It is another object of the present invention to provide a safe liquid drain opener composition.

These and other objects, advantages and features of the present invention will be set forth in more detail below.

SUMMARY

The present invention involves discovery of a critical solution temperature vs acid strength profile and comprises a liquid drain opener composition which is as effective but far less hazardous than the concentrated sulfuric acid drain openers now in common use even though the amount of sulfuric acid is considerably less than the amount of sulfuric acid required in a conventional sulfuric acid drain opener. In accordance with this invention, an excellent drain opener is provided by an aqueous solution of between about 80.8% and 84.5% by weight of sulfuric acid, about 0.1–0.5% by weight of corrosion inhibitors, and about 15–19.1% by weight of inert materials, including 10–19% water.

The above combination completely destroys sanitary napkins, paper, organic waste, cigarettes, inorganic salts and food particles, and other organic obstructions that would plug up drains in sinks, toilets, showers, bath tubs, etc. When this combination comes in contact with human flesh, it can safely be rinsed away with cold water, without resulting in severe burns or other serious tissue destruction even after a significant time delay.

FIGURE

The FIGURE graphically demonstrates the relationship between acid strength and maximum temperature developed by the composition in use.

DETAILED DESCRIPTION

The present invention includes the discovery that a significant factor leading to acid damage to skin tissue is the development of high temperature on the skin due to the exothermic heat of solution occasioned by tissue moisture in contact with the acid. Temperatures in excess of 200° F (93.3° C) may develop in localized areas leading to heat-type burns. Thes burns are then aggravated by the chemical nature of the acid, which hydrolyzes the burned tissue, thereby destroying it. In contrast, fluid temperatures below about 172° F (77.8° C) for reasonably short times, up to about 2 minutes, do not lead to severe heat burns.

A second discovery relating to the invention involves the determination that there is a critical minimum temperature threshold necessary to dissolution of typical domestic and industrial drain clogs. Where the temperature developed by the drain opener in the confined volume adjacent the clog, and penetrating into the clog, falls below about 161° F (71.6° C), the clog will resist substantial breakdown and the opener will be ineffective.

A further discovery is that a liquid drain opener composition of the acid-type of this invention becomes diluted in use in the confined volume adjacent the clog by a dilution factor which is typically about 1:1±.1, i.e., ranges from about 1:.9 to about 1:1.1. The original ambient temperature in the drains typically averages about 60° F ± 20° F (15.6° C ± 11.1° C).

The FIGURE illustrates still another important discovery relating to the invention. When sulfuric acid of various strengths (% by weight) is diluted with tap water at 60° F (15.6° C) by volume, heats of solution develop but, surprisingly, the temperature vs acid strength curve is not linear. The FIGURE graphically shows the relationship as determined by the following tests:

TABLE I

Heats of Solution Developed by $H_2SO_4$ Diluted 1:1 by Volume with 60° F Tap Water

| Acid Strength % by Weight | Maximum Temperature °F | °C |
|---|---|---|
| 79 | 156 | 68.9 |
| 80 | 158 | 70. |
| 81 | 161 | 71.6 |
| 82 | 163 | 72.8 |
| 84 | 165 | 73.9 |
| 85 | 195 | 90.6 |
| 86 | 212 | 100. |
| 87 | 215 | 101.7 |
| 88 | 218 | 103.3 |

The values in Table 1 were determined by pouring the given strength of sulfuric acid into an equal volume of tap water, both initially at 60° F (15.6° C). The temperature of solution was monitored and the maximum temperature recorded and entered on Table I.

The graph shows, surprisingly, a very sharp drop off in developed temperature between 85 and 84% acid. This is surprisingly followed by a plateau in the developed temperature curve between 81 and 84%. Thereafter, the maximum heat of solution developed under these conditions again drops off rapidly.

There is accordingly a critical range of acid strength, expressed as percentages, for a sulfuric acid drain opener composition in which the composition can still effectively dissolve drain plugging materials, such as those described above, yet which surprisingly does not cause highly severe skin burns upon immediate contact. This critical window in composition range lies between 80.8% and 84.5% sulfuric acid by weight, and is illustrated by the following eleven comparative examples of which compositions 6 through 8 illustrate the critical range. In these tests a sanitary napkin was placed in 60° F water for time sufficient to saturate it. Then various strengths of acid (weight %) at 60° F were applied by pouring into the wetted mass. The amount of water in which the napkin was contained permitted a 1:1 dilution with the acid.

TABLE II

Burn and Dissolution Results of a Sanitary Napkin in Various Strengths of Sulfuric Acid

| Ex. | Acid Strength Percentage (by weight) | Acid Specific Gravity | Temp. °F/°C | Dissolution Time | Burn Severity |
|---|---|---|---|---|---|
| 1 | 93 | 1.835 | 230/110 | 1 min | Instant |
| 2 | 88 | 1.802 | 218/103.3 | 1 min | Instant |
| 3 | 87 | 1.795 | 215/101.7 | 1 min | Instant |
| 4 | 86 | 1.787 | 212/100. | 1 min | Instant |
| 5 | 85 | 1.777 | 195/90.6 | 1 min | Instant |
| 6 | 84 | 1.769 | 165/73.9 | 2 min | 2 min |
| 7 | 82 | 1.749 | 163/72.8 | 2 min | 2 min |

TABLE II-continued

Burn and Dissolution Results of a Sanitary Napkin in Various Strengths of Sulfuric Acid

| Ex. | Acid Strength Percentage (by weight) | Acid Specific Gravity | Temp. °F/°C | Dissolution Time | Burn Severity |
|---|---|---|---|---|---|
| 8 | 81 | 1.738 | 161/71.6 | 2 min | 2 min |
| 9 | 80 | 1.727 | 158/70. | None in 24 hrs. | 5 min |
| 10 | 79 | 1.716 | 156/68.9 | None in 24 hrs. | 5 min |
| 11 | 78 | 1.704 | 154/67.8 | None in 24 hrs. | 5 min |

"Instant" in the above table under the heading "Burn Severity" indicates immediate severe skin burns on contact. "2 min" indicates that a person has typically 2 minutes to obtain water or a neutralizing agent to wash away or counteract the acid without having a burn. Correspondingly, "5 min" indicates that the person has 5 minutes to wash away or neutralize the acid. The table also demonstrates that below about 81% composition, the sanitary napkin, typical of a material that can plug drains, does not appreciably dissolve over a period of 24 hours.

Corrosion inhibitors and other inert materials may be added to the composition. I prefer to use 0.1–0.5% by weight of an organic amine corrosion inhibitor, such as "Armohib" produced by Armour & Co. I also use from 15.0–19.1% of inert materials comprising principally water (10–19%) and the balance selected from colorants (such as acid indicator type dyes for product coloring), essential oils for scenting (such as sassafras oil, eucalyptus oil, peppermint oil, pine oil, lemon oil, and the like), and viscosity builders (such as "Kelzan," a natural polymeric thickener derived from seaweed, or finely divided calcium oxide suspended in the composition).

It should be understood that various modifications within the scope of this invention can be made by one of ordinary skill in the art without departing from the spirit thereof. I therefore wish my invention to be defined by the scope of the appended claims as broadly as the prior art will permit, and in view of this specificaton if need be.

I claim:

1. A method of opening domestic or industrial drain clogs comprising of the steps of:

a. contacting said clog with an aqueous sulfuric acid composition, consisting essentially of an aqueous solution of between 80.8% to 84.5% by weight of sulfuric acid, 0.1–0.5% by weight of corrosion inhibitors, and 15.0–19.1% by weight of inert materials including 10–19% by weight of water, to dissolve said clog in less than 5 minutes;

b. said composition producing heat of solution upon dissolution with water in said drain adjacent said clog in the range of 1:1±0.1 by volume in an amount sufficient to raise the temperature of fluid adjacent said clog in the range of about 161° F (71.6° C) to 172° F (77.8° C); and c. flushing said dissolved clog material with water.

* * * * *